US007204173B2

(12) United States Patent
Buck

(10) Patent No.: US 7,204,173 B2
(45) Date of Patent: Apr. 17, 2007

(54) ROTATABLE DIE TONG JAW

(76) Inventor: David A. Buck, 1348 Sawmill Hwy., Breaux Bridge, LA (US) 70517

( * ) Notice: Subject to any disclaimer, the term of this patent is extended or adjusted under 35 U.S.C. 154(b) by 98 days.

(21) Appl. No.: 10/913,033

(22) Filed: Aug. 6, 2004

(65) Prior Publication Data

US 2006/0027047 A1 Feb. 9, 2006

(51) Int. Cl.
*B25B 17/00* (2006.01)

(52) U.S. Cl. ..... 81/57.18; 81/57.2; 81/57.21

(58) Field of Classification Search ..... 81/57.18, 81/57.2, 57.21, 57.33, 57.36, 57.34
See application file for complete search history.

(56) References Cited

U.S. PATENT DOCUMENTS 1,561,833 A 11/1925 Cruickshank
4,246,809 A * 1/1981 Keast et al. ..... 81/57.16
4,346,629 A * 8/1982 Kinzbach ..... 81/57.2
4,401,000 A * 8/1983 Kinzbach ..... 81/57.2
RE31,699 E 10/1984 Eckel
4,709,599 A 12/1987 Buck
4,836,064 A * 6/1989 Slator ..... 81/57.18
5,022,291 A 6/1991 McBain
5,167,173 A 12/1992 Pietras
5,671,961 A * 9/1997 Buck ..... 294/116
5,845,549 A 12/1998 Bouligny
6,070,500 A * 6/2000 Dlask et al. ..... 81/57.33
6,116,118 A 9/2000 Wesch, Jr.
6,327,938 B1 * 12/2001 Pietras ..... 81/57.33
6,378,399 B1 * 4/2002 Bangert ..... 81/57.15
6,755,097 B2 * 6/2004 Bangert ..... 81/57.5
6,845,814 B2 * 1/2005 Mason et al. ..... 166/75.14
2004/0055421 A1 3/2004 Bangert

* cited by examiner

*Primary Examiner*—Lee D. Wilson
*Assistant Examiner*—Alvin J. Grant
(74) *Attorney, Agent, or Firm*—Jones, Walker, Waechter, Poitevent, Carrere & Denegre, L.L.P.

(57) ABSTRACT

Power tong jaws comprising one or more dies which are rotatable.

18 Claims, 8 Drawing Sheets

ROTATABLE DIE TONG JAW

The present invention relates to pipe tongs or power tongs used in the oil and gas industry to make-up and break-out sections of drill pipe and other tubular members having threaded connections. More particularly, the present invention relates to tong jaws comprising one or more dies which are rotatable.

I. BACKGROUND OF THE INVENTION

Power tongs are often employed in the oil and gas industry to break-out or make-up threaded connections on tubular members (such as drill pipe, tubing, and casing). It is generally required that one tong grip and rotate one section of a tubular string and a second tong grip and hold stationary the other section of the tubular string. The tong which rotates the section of the tubular member is typically referred to as the power tong, while the tong which holds the other section of the tubular member stationary is typically referred to as the back-up tong. Examples of conventional power tongs can be seen in references such as U.S. Pat. Nos. 5,671,961, 5,702,139, and 5,819,604 to Buck, each of which is incorporated herein by reference in its entirety.

Power tongs typically have two or more jaws which are actuated to grip and release the tubular member. There are generally two types of jaws—pivoting jaws and sliding jaws. Both pivoting jaw and sliding jaw power tongs are well known in the art. An example of a pivoting jaw power tong can be seen in U.S. Pat. No. 4,350,062 to Farr et al., which is incorporated by reference herein. FIG. 1 illustrates the basic components of a typical pivoting jaw power tong 1. A tong body 2 encloses a ring gear 3 which has a cam surface 4. Positioned within ring gear 3 are the pivoting jaws 5. Pivoting jaws 5 are pivotally attached between an upper and lower tong cage plate (not shown) by pivot pin 7. A roller 6 on pivoting jaws 5 engages cam surface 4 on ring gear 3. As is well known in the art, the rotation of ring gear 3 causes different sections of cam surface 4 to either push roller 6 toward tubular member 100 (causing the jaws to grip the tubular member) or allow roller 6 to move away from tubular member 100 (causing the jaws to release the tubular member).

An example of a sliding jaw power tong may be seen in U.S. Pat. No. 5,435,213 to Buck, which is incorporated by reference herein in its entirety. A sliding jaw power tong has a tong body and ring gear structure similar to a pivoting jaw power tong, but the jaw is not pinned to the cage plates. The sliding jaw is moved radially toward the tubular member by way of the ring gear's cam surfaces acting on the sliding jaws' rollers. Sliding jaws could also include radially moving jaw arrangements such as seen in U.S. patent application Ser. No. 10/421,041, filed on Apr. 23, 2003 to Bangert, entitled Improved Tong Piston and Cylinder Assembly, which is incorporated herein in its entirety.

Actual contact with the tubular member is typically accomplished through the use of die inserts which are removably positioned in the power tong jaws. Typical die inserts have gripping surfaces which contain a number of ridges or teeth, or have alternative gripping surfaces such as those disclosed in U.S. Pat. No. 6,378,399 to Bangert, which is incorporated by reference herein in its entirety. When the jaws close upon the tubular member, the teeth firmly "bite" into the tubular member and prevent slippage when torque is applied. In most conventional tong jaw systems, the jaws are designed to grip a tubular member of a particular nominal diameter (or a limited range of nominal diameters) and the dies are in a fixed orientation relative to the jaw body. The dies are positioned on the jaw at an angle to maximize the contact between the face of the die and the surface of the tubular member. Because the diameters of tubular members are allowed to vary within certain tolerances, the exact diameter of the tubular member being gripped can vary, especially when dealing with large diameter tubular members. Particularly in the case of prior art pivoting jaw systems, differing diameters may prevent all of the dies from squarely engaging the surface of the tubular member and in extreme cases may completely prevent one or more of the dies from contacting the surface of the tubular member.

II. BRIEF DESCRIPTION OF THE DRAWINGS

Figure 3A:
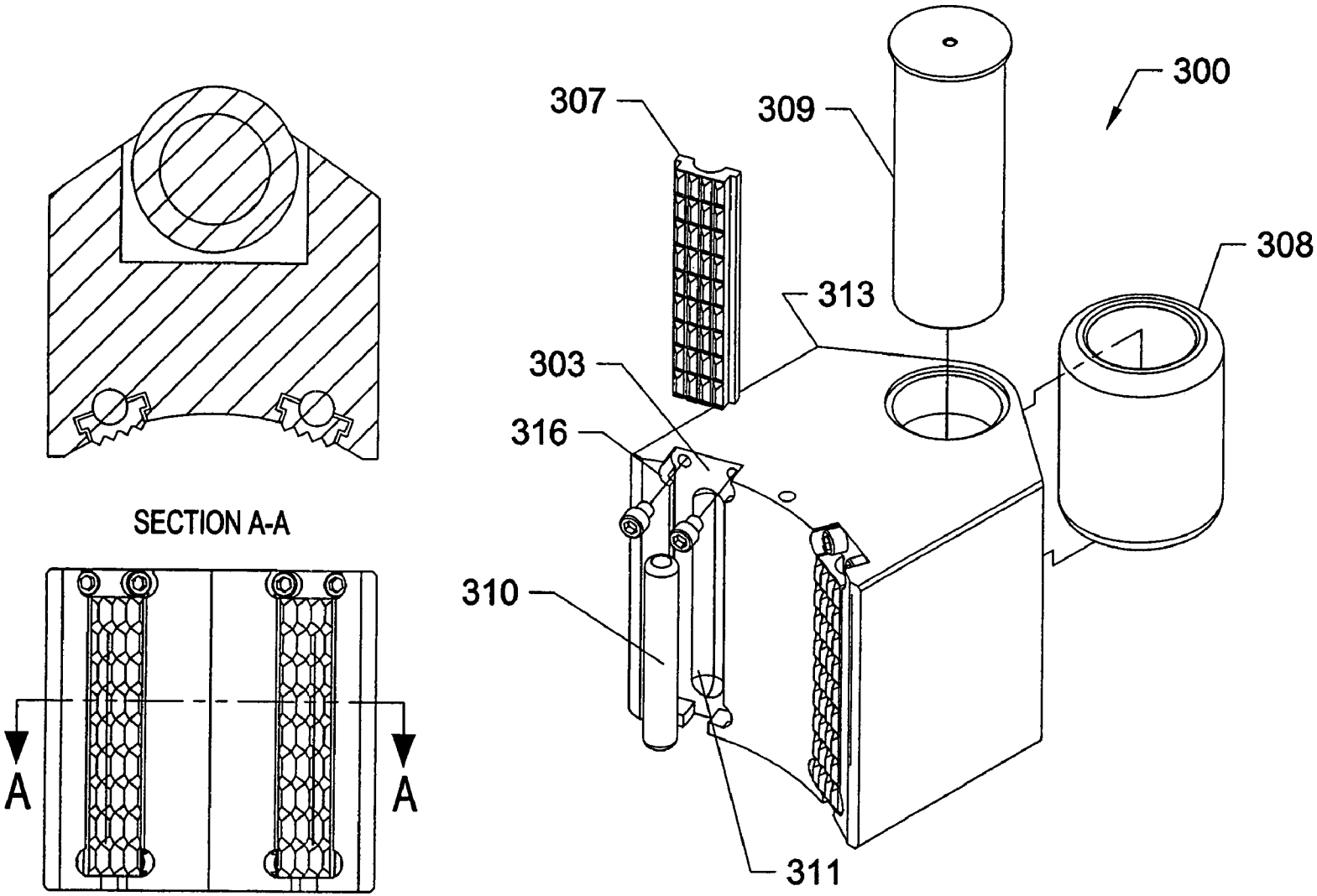

FIG. 3*a* is a perspective view of a solid sliding tong jaw comprising a rotatable die assembly according to the present invention.

Figure 3B:
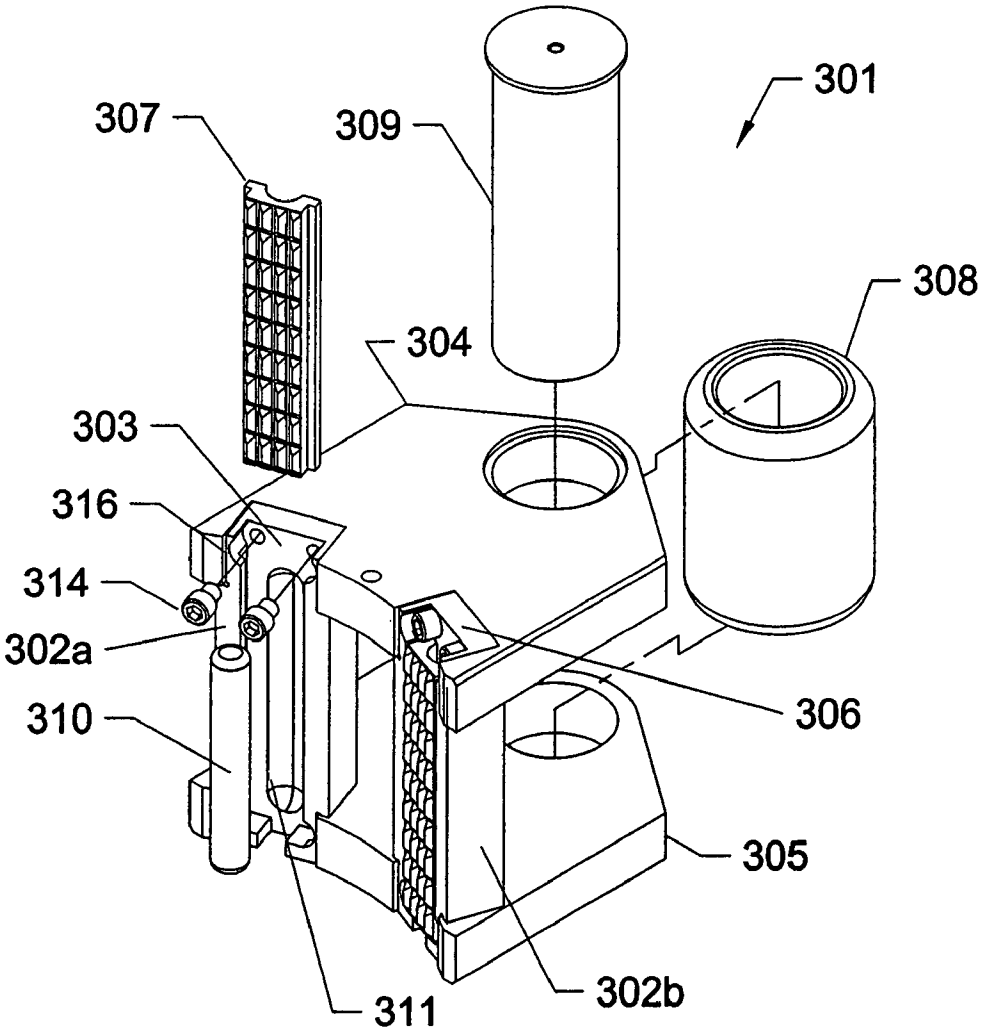
Figure 3B:
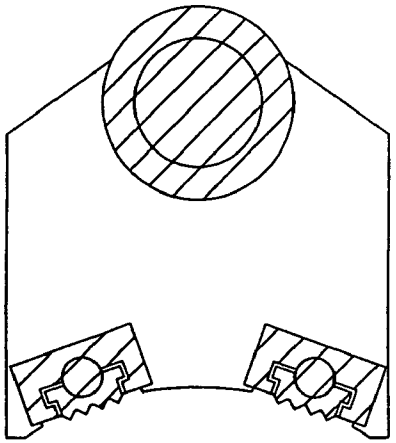
Figure 3B:
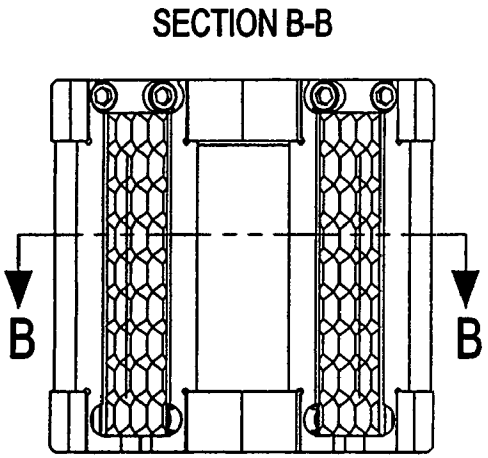

FIG. 3*b* is a perspective view of a multiple piece sliding tong jaw comprising a rotatable die assembly according to the present invention.

Figure 3C:
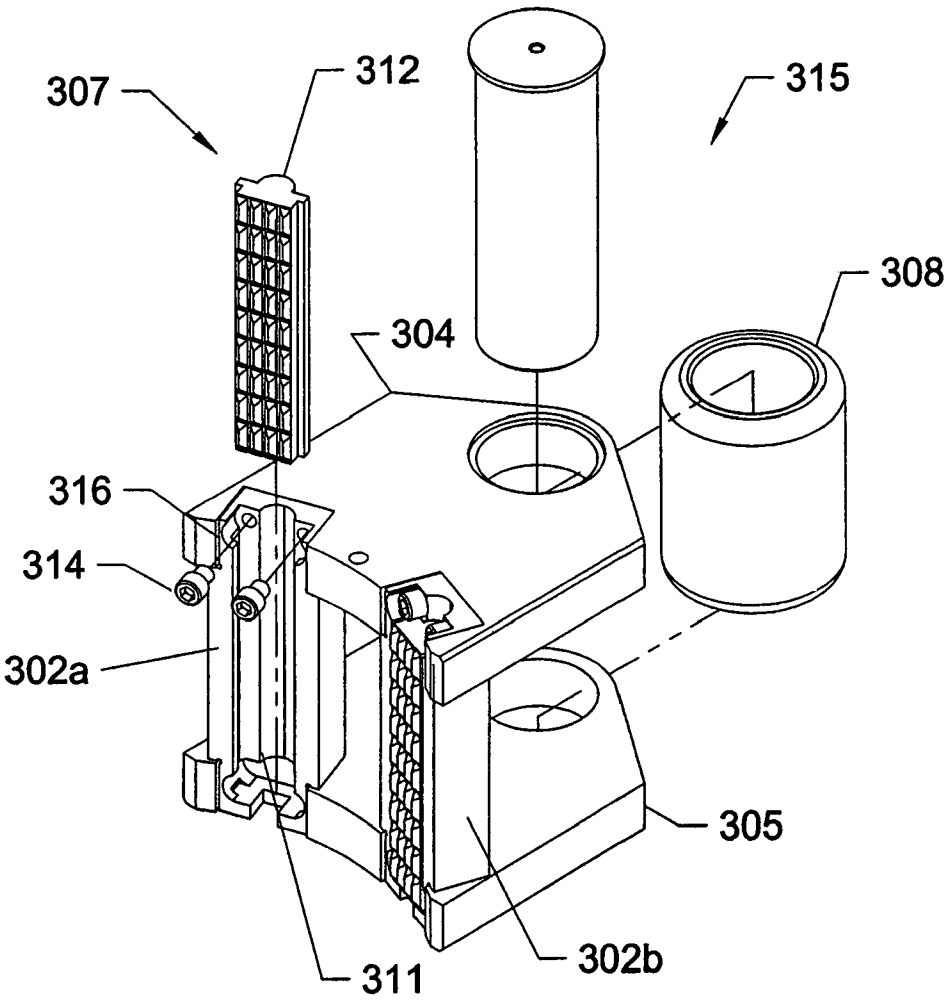
Figure 3C:
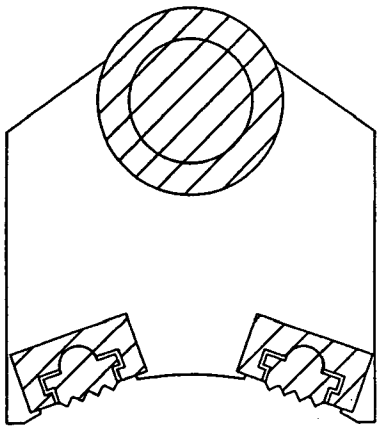
Figure 3C:
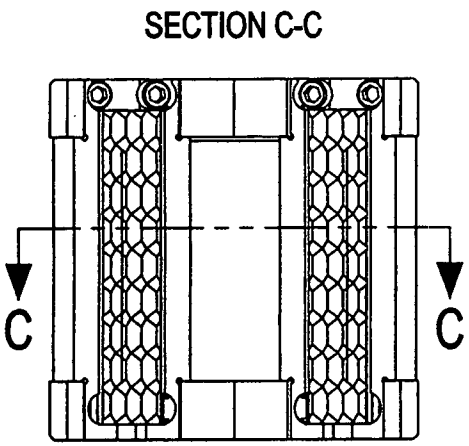

FIG. 3*c* is a perspective view of a multiple piece sliding tong jaw comprising a rotatable die assembly comprising a die with an integrally formed rocker bar.

Figure 4A:
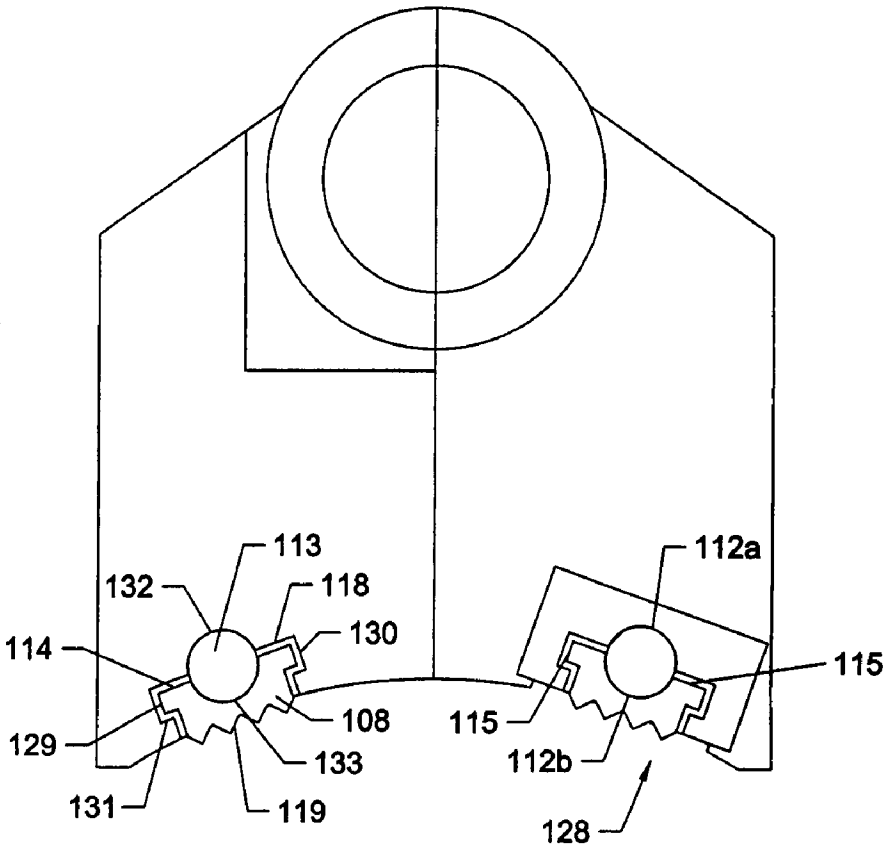

FIG. 4*a* is a cross-sectional view of a sliding tong jaw comprising a rotatable die assembly according to the present invention.

Figure 4B:
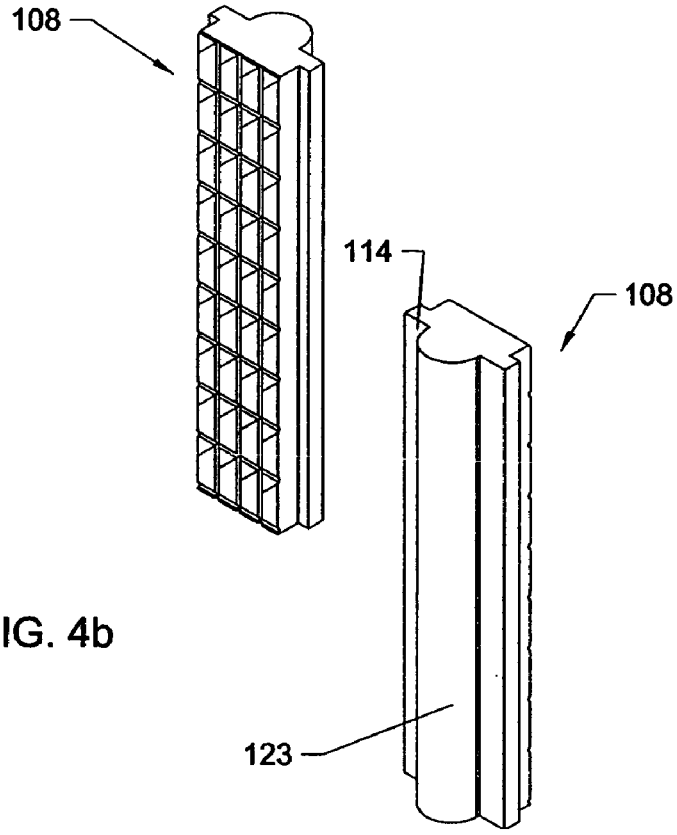

FIG. 4*b* illustrates perspective front and rear views of two dies comprising integrally formed rocker bars.

Figure 5:
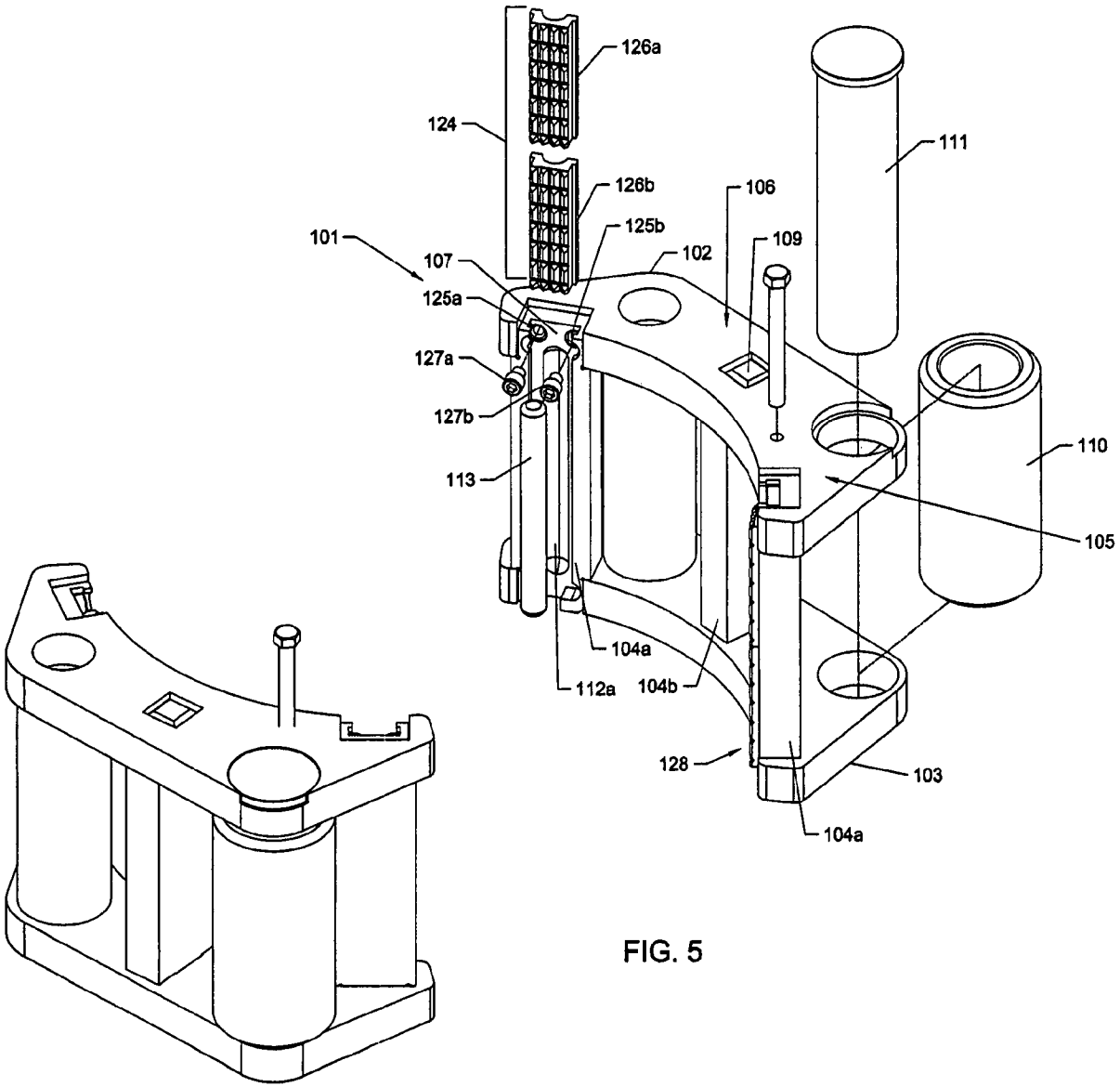

FIG. 5 is a perspective view of a pivoting tong jaw comprising a rotatable die assembly according to the present invention.

Figure 6C:
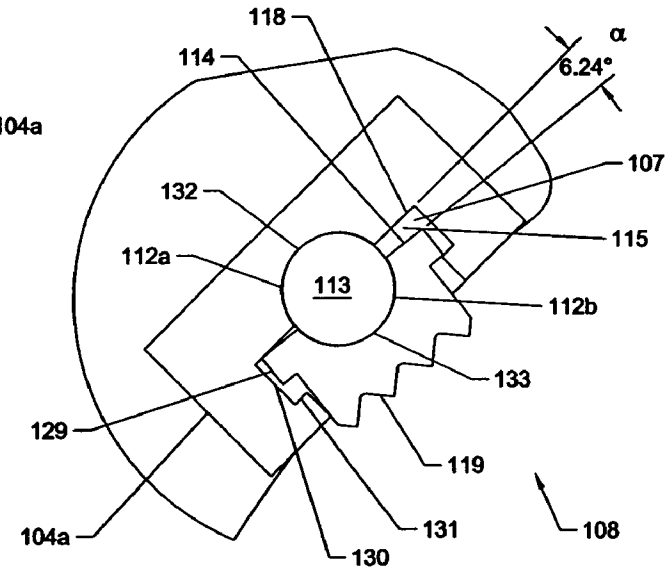
Figure 6B:
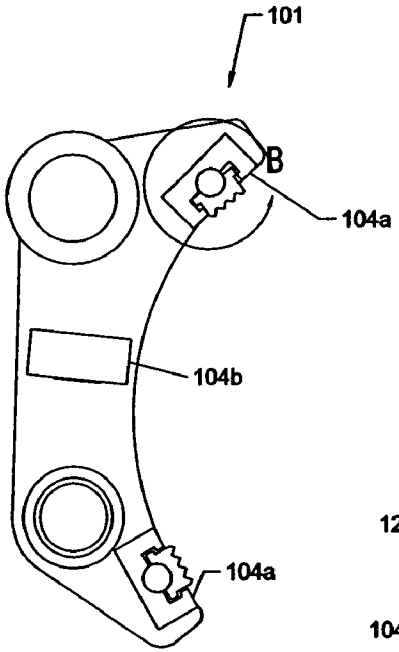
Figure 6A:
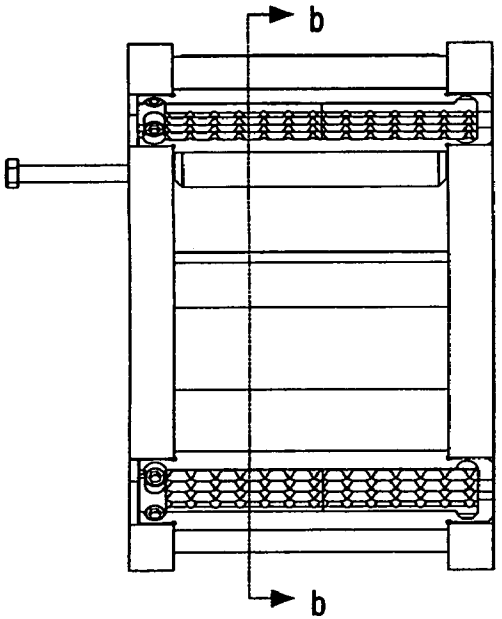

FIG. 6*a* is a plan front view of a pivoting tong jaw comprising a rotatable die assembly according to the present invention.

FIG. 6*b* is a top cross-sectional view of the pivoting tong jaw shown in FIG. 6*a* along the plane indicated in FIG. 6*a*.

FIG. 6*c* is an enlarged top view of the rotatable die assembly shown in FIG. 6*b*.

III. DESCRIPTION OF THE INVENTION

The following description of embodiments of the present invention refers to the accompanying figures. The term "power tong" as used herein refers to both power tongs for rotating tubular members and back-up power tongs for holding tubular members stationary against rotation.

Figure 1:
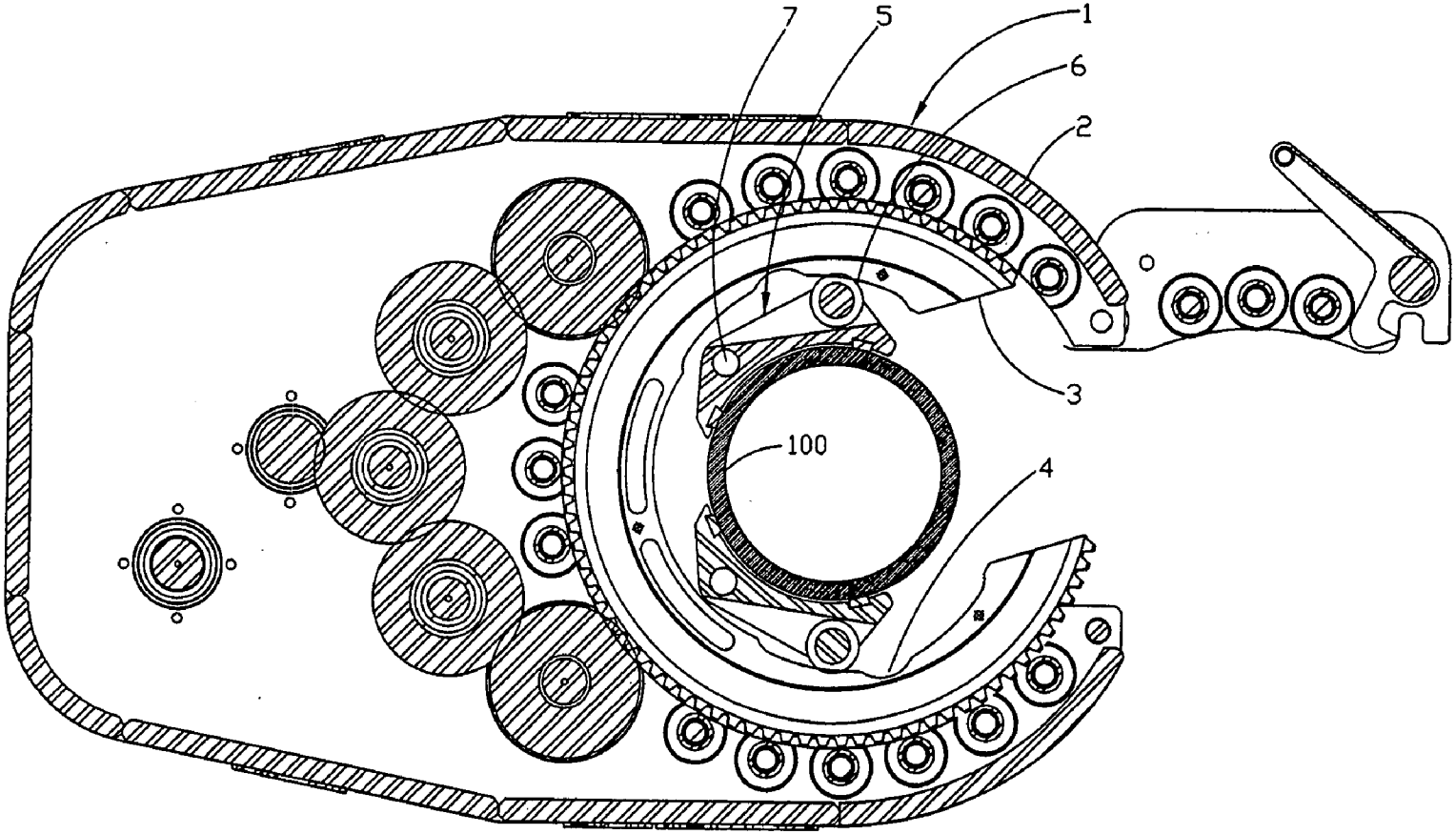
FIG. 1 PRIOR ART
FIG. 1 is a top plan view of the drive train, ring gear, and jaws of a prior art pivoting jaw power tong.
Figure 2:
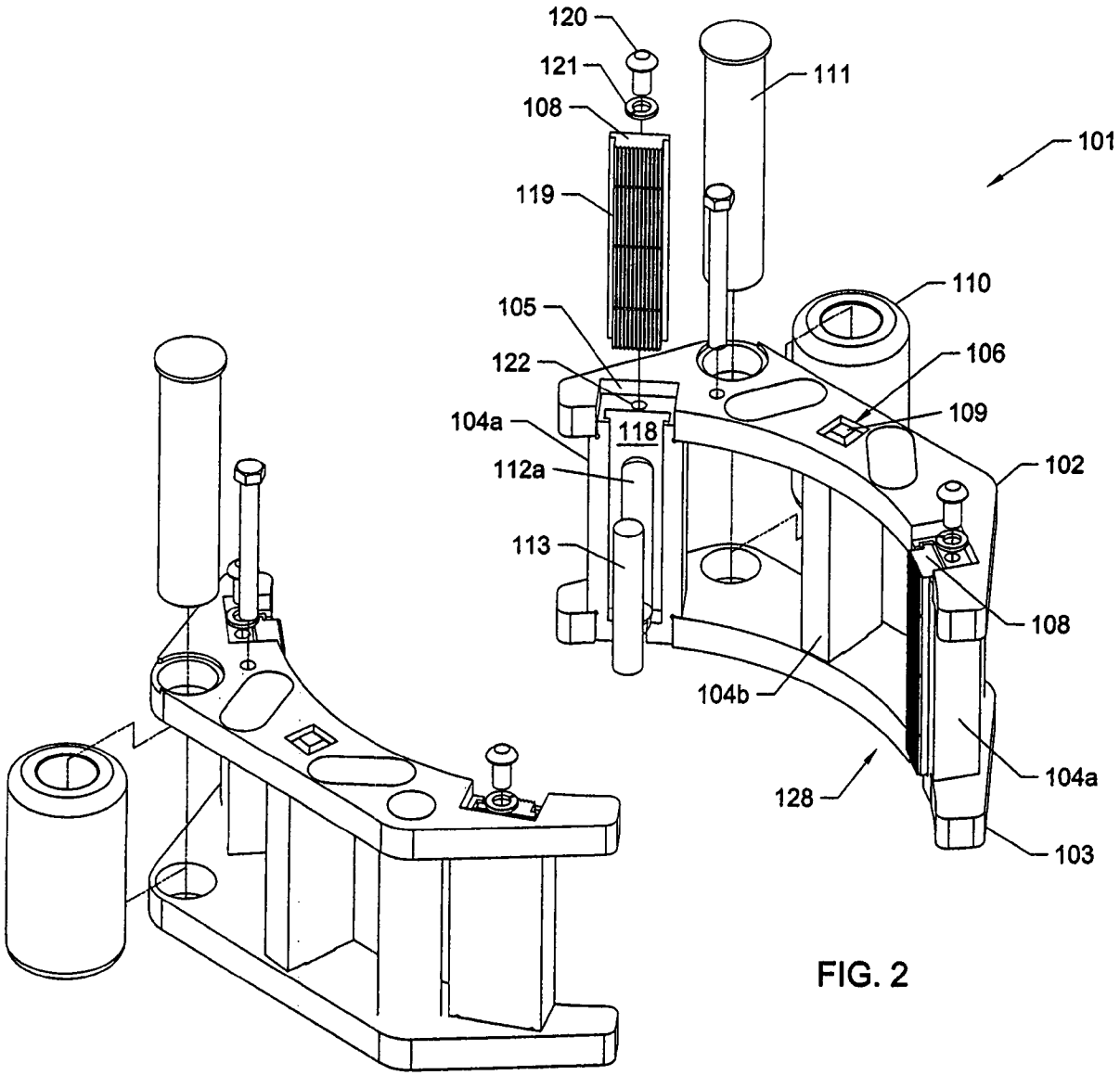
FIG. 2 is a perspective view of a pivoting power tong jaw comprising a rotatable die assembly according to the present invention.

In one embodiment, the invention comprises the pivoting power tong jaw 101 shown in FIG. 2. The jaw 101 comprises an upper plate 102, a lower plate 103, and three column members 104. Upper plate 102 and lower plate 103 are arranged horizontally, the former above the latter. Upper plate 102 and lower plate 103 each contain two column member slots 105 and one column member opening 106. In one aspect, upper 102 and lower 103 plates will be formed by a high speed, precision cutting process. Examples of high speed precision cutting processes would include laser cutting or water jet cutting, shear or punch press types of heavy metal fabrication techniques, and may include plasma torch cutting. Plasma torch cutting and flame torch cutting would generally not be considered precision cutting processes, and conventional milling would not be considered high speed, although these methods could be used in less preferred embodiments for producing the plates, as could casting processes. As illustrated in FIG. 2, each column member 104 is positioned vertically. Two column members 104*a* have die retaining grooves 107 formed in them for receiving and retaining dies 108. (An enlarged view of a column member 104*a* is depicted in FIG. 6*c*, which clearly shows die retaining groove 107.) Column members 104*a* having die retaining grooves 107 are positioned between upper plate 102 and lower plate 103 such that each end of each of column members 104*a* fits into a corresponding column member slot 105. Column members 104 are welded into place, or secured by another common method (e.g., using bolts or screws). The third column member 104*b* is also positioned between upper plate 102 and the lower plate 103. This column member 104*b* does not have a die retaining groove 107 and has points 109 at each end which extend through column member openings 106 in upper plate 102 and lower plate 103, thereby stabilizing column member 104*b*. This embodiment further comprises a roller 110 which, as noted above, engages the cam surface of the power tong's ring gear as suggested by FIG. 1. Roller 110 is held in place with roller pin 111.

In the embodiment shown in FIG. 2, jaw 101 comprises a rotatable die assembly 128. Rotatable die assembly 128 comprises a die 108 which fits into die retaining groove 107 and is secured by die top pin 120 and die washer 121. Die top pin 120 extends through die washer 121 into a top hole 122 while die washer 121 extends over part of the top of die 108, thereby preventing die 108 from sliding up and out of die retaining groove 107. A rocker bar recess 112*a* is formed in the back 118 of die retaining groove 107 and is shaped to receive one side of a rocking bar 113. As is best shown in FIGS. 4*a* and 6*c*, another rocking bar recess 112*b* is formed in the back 114 of die 108. Rocker bar recess 112*b* accommodates the other side of rocker bar 113. As is shown best in FIGS. 4*a* and 6*c*, die retaining groove 107 and die 108 comprise substantially rectangular side sections 130 and 129, respectively. Rocker bar recesses 112*a* and 112*b* form arcuate center sections in die retaining groove 107 and die 108, 132 and 133, respectively. The circumference of rocker bar 113 is sized such that not all of the circumference of rocker bar 113 is housed by rocker bar recess 112*a* and rocker bar recess 112*b*, i.e., a gap 115 is formed between the surface of die retaining groove 107 and the surface of die 108. Rocker bar 113 functions to separate the surface of die 108 from the surface of die retaining groove 107. Because die retaining groove 107 is larger than die 108, die 108 fits loosely in die retaining groove 108—i.e., gap 115 (see FIGS. 4*a* and 6*c*) extends around the sides and back of die and allows room for die 108 to rotate or rock back and forth within die retaining groove 107 around the vertical axis formed by rocker bar 113.

It will be understood that uneven pressure on face 119 of die 108 will cause die to rotate or rock about the vertical axis defined by rocker bar 113. As die 108 rotates or rocks, the angle $\alpha$ (see FIG. 6*c*) between back 118 of die retaining groove 107 and back 114 of die 108 varies. As shown in FIG. 6*c*, Die 108 will rotate until it comes into contact with the surface of die retaining groove 107. One end of back 114 of die 108 is capable of engaging back 118 of die retaining groove 107, while the opposite end of back 114 of die 108 engages front 131 of die retaining groove 107. In the embodiment shown in FIG. 6*c*, the maximum value achievable for angle $\alpha$ is 6.24. However, the invention is not limited to a particular value of $\alpha$, and this parameter could vary for different jaw sizes and arrangements. This rotation or rocking allows face 119 of die 108 to squarely engage the surface of a tubular member (not shown) to maximize the grip of jaw 101 regardless of the exact diameter of the tubular member or shape of the surface of the tubular member. As shown in FIGS. 4*a* and 6*c*, the diameter of rocker bar 113 and integral rocker bar 123 is smaller than the width of die 108. The size and shape of die 108, die retaining groove 107, and rocker bar 113 may vary, but these components of the rotatable die assembly 128 should be of a size and shape that allows die 108 to fit matingly into die retaining groove 107 such that when the face 119 of die 108 is parallel to the back 118 of die retaining groove 107, a gap 115 is left between the surface of die 108 and the surface of die retaining groove 107. Gap 115 allows for the rocking or rotational movement described above. For example, alternate rocker bars might have a cross-section that is elliptical in shape instead of being circular, it is only necessary that the die be capable of rocking to the degree necessary to squarely engage the tubular.

In another embodiment, shown in FIG. 4*b*, an integral rocker bar 123 is formed in back 114 of die 108 by casting or milling or by any other conventional process. Integral rocker bar 123 fits into rocker bar recess 112*b* in the same manner as described above for the die 108 having a separate rocker bar 113.

In another embodiment, shown in FIG. 5, the invention comprises a die assembly 124 comprising two dies 126*a* and 126*b*. This embodiment is used in large jaw systems where a single die does not provide a sufficiently long gripping surface. Die assembly 124 is prevented from sliding up and out of die retaining groove 107 by die face pins 127 which fit into face holes 125 in the top portion of die retaining groove 107 above die assembly 124. It will be understood that die face pins 127 could be substituted for die top pin 120 in the embodiment shown in FIG. 2 to prevent die 108 from sliding up and out of die retaining groove 107.

In other embodiments, the invention may be adapted for sliding power tong jaws such as those shown in FIG. 3. FIG. 3*a* shows a solid sliding tong jaw 300, and FIGS. 3*b* and 3*c* show sliding tong jaws 301 and 315 formed from multiple pieces. Examples of jaws formed from multiple pieces can be seen in the U.S. patent application entitled "Tong Jaw and Method for Constructing the Tong Jaw," Ser. No. 10/638,783 which is incorporated herein by reference in its entirety. Similar to the pivoting jaws described above, jaws 301 and 315 each comprise an upper plate 304, a lower plate 305, and two column members 302. Upper plate 304 and lower plate 305 are arranged horizontally, the former above the latter. The upper plate 304 and lower plate 305 contain column member slots 306 which allow column members 302 to connect upper plate 304 and lower plate 305. As illustrated in FIG. 3*b*, column members 302 are positioned such that die inserts 307 face inwardly in an arcuate orientation corresponding approximately to the diameter of the tubular member to be gripped, thereby allowing both of the die inserts 307 to come into contact with the surface of the tubular member when the power tong jaw member 301 is in use. In the embodiment shown in FIG. 3*b*, jaw 301 comprises a rocker bar 310 and rocker bar recess 311, which function as described above to allow die 307 to rock or rotate about the vertical axis defined by rocker bar 310. The embodiment shown in FIG. 3*c* comprises a die 307 which comprises an integral rocker bar 312 as described above.

Jaw 300 (shown in FIG. 3*a*) comprises a jaw body 313 which comprises die retaining grooves 303 formed in the face 317 of jaw body 313. As in the embodiment shown in FIG. 3*b*, the face 317 of jaw body 313 has an arcuate shape, and die retaining grooves 303 are positioned such that the die inserts 307 face inwardly in an arcuate orientation corresponding approximately to the diameter of the tubular member to be gripped. In the embodiment shown in FIG. 3*a*, jaw 300 comprises a rocker bar 310 and rocker bar recess 311, which function as described above to allow die 307 to rock or rotate about the vertical axis defined by rocker bar 310.

While certain embodiments and examples have been used to describe the present invention, many variations are possible and are intended to be within the scope of the invention. Such variations will be apparent to those skilled in the art upon inspection of the description and the claims herein.

What is claimed is:

1. A power tong comprising at least one rotatable die assembly which further comprises:

i. a die retaining groove having first and second sides;

ii. at least one die which is rotatable, said die having a face and a back and said die being sized to fit loosely within said die retaining groove and rotate between said first and second sides of said die retaining groove in order to adjust the angle at which said die is capable of engaging a tubular member; and iii. a rocker bar which is positioned within said die retaining groove between the surface of said die retaining groove and said back of said die.

2. The power tong of claim 1, wherein said rocker bar is integrally formed in said back of said die.

3. The power tong of claim 1, wherein the width of said rocker bar is less than the width of said die.

4. A power tong jaw comprising:

a. at least one die which is rotatable, said die having a back including an arcuate section and being positioned within a die retaining groove; and b. a rocker bar which is positioned within said die retaining groove between the surface of said die retaining groove and said back of said die.

5. The power tong jaw of claim 4, wherein said arcuate section comprises a rocker bar integrally formed in said back of said die.

6. The power tong jaw of claim 4, wherein said power tong jaw is a pivoting power tong jaw.

7. The power tong jaw of claim 4, wherein said power tong jaw is a sliding power tong jaw.

8. The power tong jaw of claim 4, wherein the width of said rocker bar is less than the width of said die.

9. The power tong jaw of claim 4, wherein said arcuate section comprises a groove adapted to engage a separately formed rocker bar.

10. A rotatable die assembly comprising:

i. at least one die comprising a face for gripping a tubular member and a back located opposite said face, said die being positioned loosely within a die retaining groove; and ii. each of said die back and retaining groove comprising an arcuate surface allowing said die to rotate in said retaining groove.

11. The rotatable die assembly of claim 10, wherein said arcuate surface on said die back comprises either: i) a rocker bar integrally formed on said back of said die; or ii) a groove for mating with a separately formed rocker bar.

12. The rotatable die assembly of claim 11 wherein the width of said arcuate surface is less than the width of said die.

13. A power tong jaw comprising:

a. a jaw body comprising at least one die retaining groove, said die retaining groove comprising a back, a front, substantially rectangular side sections, and an arcuate center section;

b. a die insert having a back, substantially rectangular side sections and an arcuate center section;

c. a rocker bar positioned between said die retaining groove and said die insert.

14. The power tong jaw of claim 13, wherein said rocker bar is separately formed from said die retaining groove and said die insert.

15. The power tong jaw of claim 14, wherein said die is positioned such that it may rock around said rocker bar within said die retaining groove.

16. The power tong jaw of claim 15, wherein said die is positioned such that an end of said back of said die is capable of engaging said back of said die retaining groove, while the opposite end of said back of said die engages said front of said die retaining groove.

17. The power tong jaw of claim 13, wherein said rocker bar is integrally formed with said die and comprises said arcuate center section of said die.

18. A rotating die for use in a power tong jaw, said die comprising:

a. a rectangular body;

b. a face formed on said body and comprising a gripping surface for gripping a tubular member; and c. a back formed on said body opposite said face, said back comprising an arcuate center section comprising a groove for engaging a rocker bar positioned in said power tong jaw.

* * * * *